US005702855A

United States Patent [19]

Ikegami et al.

[11] Patent Number: 5,702,855

[45] Date of Patent: Dec. 30, 1997

[54] ELECTROPHOTOGRAPHIC PHOTOCONDUCTOR CONTAINING A MIXTURE OF A PHENOL COMPOUND AND AN ORGANIC SULFUR-CONTAINING COMPOUND

[75] Inventors: Takaaki Ikegami, Susono; Takashi Rokutanzono, Tachikawa; Eiji Kurimoto, Numazu, all of Japan

[73] Assignee: Ricoh Company, Ltd., Tokyo, Japan

[21] Appl. No.: 692,095

[22] Filed: Aug. 7, 1996

[30] Foreign Application Priority Data

Aug. 9, 1995 [JP] Japan ..... 7-224780
Jul. 5, 1996 [JP] Japan ..... 8-195365

[51] Int. Cl.[6] ..... G03G 5/09

[52] U.S. Cl. ..... 430/83; 430/56

[58] Field of Search ..... 430/83, 56

[56] References Cited

U.S. PATENT DOCUMENTS

| | | | |
|---|---|---|---|
| 4,932,860 | 6/1990 | Yoshihara et al. | 430/58 |
| 5,013,625 | 5/1991 | Takizawa et al. | 430/64 |
| 5,308,727 | 5/1994 | Osawa et al. | 430/66 |

*Primary Examiner*—John Goodrow
*Attorney, Agent, or Firm*—Oblon, Spivak, McClelland, Maier & Neustadt, P.C.

[57] ABSTRACT

An electrophotographic photoconductor has an electroconductive support, and a single-layered photoconductive layer formed thereon containing a charge generation material, a charge transport material, a binder resin and a mixture of a phenol compound and an organic sulfur-containing compound.

10 Claims, 4 Drawing Sheets

ELECTROPHOTOGRAPHIC PHOTOCONDUCTOR CONTAINING A MIXTURE OF A PHENOL COMPOUND AND AN ORGANIC SULFUR-CONTAINING COMPOUND

BACKGROUND OF THE INVENTION

1. Field of the Invention

The present invention relates to an electrophotographic photoconductor, in particular to a single-layered electrophotographic photoconductor for use in a copying machine and a printer.

2. Discussion of Background

Various inorganic materials such as selenium, cadmium sulfide and zinc oxide are conventionally employed as the photoconductive materials for an electrophotographic photoconductor. However, those inorganic materials cannot satisfy all the requirements for the photoconductive materials, for example, in terms of the photosensitivity, thermal stability and durability, and there is the problem in the manufacturing conditions.

To be more specific, selenium tends to readily crystallize by the application of heat or the deposition of dust, so that the properties of selenium easily deteriorate. In addition, the selenium photoconductor has the shortcomings that the manufacturing cost is high, and that it must be handled with the utmost care because of its toxicity and poor impact resistance.

The cadmium sulfide photoconductor has also the shortcomings that the moisture resistance and the durability are inferior, and there is the problem in toxicity. Further, the moisture resistance and the durability of the zinc oxide photoconductor are also poor.

Instead of the photoconductor employing the inorganic photoconductive material, research and development of the organic photoconductor, namely, the photoconductor employing the organic photoconductive material has been actively conducted because the organic photoconductive material has excellent film-forming properties, the manufacturing cost is low, and a variety of organic compounds can be selected in a wide range.

As the organic electrophotographic photoconductors, there are conventionally known a function-separating electrophotographic photoconductor of which photoconductive layer is a laminated one comprising a charge generation layer and a charge transport layer; and an electrophotographic photoconductor comprising a single-layered photoconductive layer which comprises a binder resin and a charge generation material dispersed in the binder resin. In particular, the aforementioned function-separating laminated photoconductor has become the mainstream in the electrophotographic field because of its high sensitivity.

Many laminated electrophotographic photoconductors are conventionally proposed. For example, there is known an electrophotographic photoconductor comprising a charge generation layer which comprises chlorodiane blue, and a charge transport layer which comprises a hydrazone compound as disclosed in Japanese Patent Publication 55-42380. Many kinds of charge generation materials for use in the laminated electrophotographic photoconductor are proposed, for example, in Japanese Laid-Open Patent Applications 53-133445, 54-21728 and 54-22834; while many kinds of charge transport materials are proposed in Japanese Laid-Open Patent Applications 58-198043 and 58-199352. Most of the organic electrophotographic photoconductors put to practical use are the above-mentioned electrophotographic photoconductors comprising the laminated photoconductive layer.

However, it is necessary that the thickness of the charge generation layer of the laminated electrophotographic photoconductor be decreased to 0.1 to 1.0 μm for obtaining high sensitivity. Therefore, the formation of the charge generation layer is influenced by the surface condition of the electroconductive support and the atmosphere in the course of coating operation, and consequently, the yield is not stable and the manufacturing cost is increased. Furthermore, the charge transport material for use in the charge transport layer is required to have high charge mobility for obtaining the high sensitivity. Most of the charge transport materials with high charge mobility are positive-hole transporting materials, so that the laminated electrophotographic photoconductors put to practical use are limited to the negatively-chargeable type.

In general, negative corona discharge is utilized for the negatively-chargeable photoconductor, so that large quantities of ozone and a nitrogen oxide gas (NOx) are generated. Those gases have an adverse effect on the human body, and decrease the life of the electrophotographic photoconductor itself by the reaction with the materials for use in the photoconductor.

To solve the above-mentioned problem, there are proposed special systems, for instance, a charging system for minimizing the generation of a gas such as ozone, a system for decomposing the generated gas, and a system for exhausting the gas generated in the apparatus. However, those special systems make the process complicated.

On the other hand, the electrophotographic photoconductor comprising a single-layered photoconductive layer which can be applied to the positive charging process has been actively studied. For example, there are known a single-layered photoconductive layer comprising polyvinylcarbazole and 2,4,7-trinitro-9-fluorenone, as disclosed in Japanese Patent Publication 50-10496; a single-layered photoconductive layer prepared by sensitizing a polyvinylcarbazole with a pyrylium salt pigment, as disclosed in Japanese Patent Publication 48-25658; a single-layered photoconductive layer comprising as a main component a eutectic crystal complex; a single-layered photoconductive layer comprising a charge generation material and a charge transport material, as disclosed in Japanese Laid-Open Patent Application 47-30330; a single-layered photoconductive layer comprising a perylene pigment and a charge transport material, as disclosed in Japanese Laid-Open Patent Applications 63-271461, 1-118143 and 3-65961; and a single-layered photoconductive layer comprising a phthalocyanine compound and a binder resin, as disclosed in Japanese Laid-Open Patent Application 3-65961.

However, the above-mentioned conventional single-layered electrophotographic photoconductors are unsatisfactory with respect to the photosensitivity and the charging stability in the repeated operations. Further, in the light of the structure of the single-layered photoconductor, the charge generation material which tends to easily deteriorate by contact with the previously mentioned oxidizing gases is necessarily present in the surface portion of the photoconductor. Therefore, the charging stability of the single-layered photoconductor is inferior to that of the laminated electrophotographic photoconductor in the atmosphere of an oxidizing gas.

SUMMARY OF THE INVENTION

Accordingly, a first object of the present invention is to provide a single-layered electrophotographic photoconductor with high photosensitivity, and stable charging characteristics even after the repeated operations or in the atmosphere of an oxidizing gas, that is, an electrophotographic photoconductor having a long life and high reliability, capable of producing clear images for an extended period of time without the decrease of image density and the toner deposition on the background.

A second object of the present invention is to provide a single-layered electrophotographic photoconductor which can be manufactured at low cost.

The above-mentioned first and second objects of the present invention can be achieved by an electrophotographic photoconductor comprising an electroconductive support, and a single-layered photoconductive layer formed thereon comprising a charge generation material, a charge transport material, a binder resin and a mixture of a phenol compound and an organic sulfur-containing compound.

In the above-mentioned electrophotographic photoconductor, the mixture may comprise the phenol compound and the organic sulfur-containing compound at a ratio by weight of 1:10 to 10:1.

Further, it is preferable that the amount of the mixture comprising the phenol compound and the organic sulfur-containing compound be in the range of 0.1 to 2 parts by weight to 10 parts by weight of the binder resin.

In addition, it is preferable that the phenol compound comprise a hindered phenol or hydroquinone compound, and that the organic sulfur-containing compound comprise a dialkyl thioalkylated compound.

In addition, it is preferable that the amount of the charge generation material be in the range of 0.1 to 10 parts by weight to 10 parts by weight of the binder resin, and that the amount of the charge transport material be in the range of 1 to 15 parts by weight to 10 parts by weight of the binder resin.

Further, it is preferable that the charge transport material comprise a compound having an oxidation potential of +0.5 V or more (vs SCE).

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
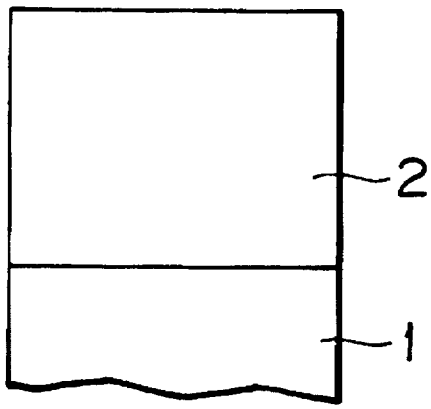
FIG. 1 is a schematic cross-sectional view of a first example of an electrophotographic photoconductor according to the present invention.

In the electrophotographic photoconductor according to the present invention, a single-layered photoconductive layer comprises a mixture of a phenol compound and an organic sulfur-containing compound. As a result, the charging stability in the repeated operations, in particular, the durability of the photoconductor with respect to the oxidizing gases is improved. The reason for this has not been clarified, but it is supposed that the mutual action be induced in the single-layered photoconductor by mixing the phenol compound and the organic sulfur-containing compound, and that the obtained mixture be readily allowed to react with the oxidizing gas to prevent the generation of a trap.

Any conventional phenol compounds can be used in the present invention. In particular, hindered phenol compounds are preferably employed because the side effects caused by the addition of the phenol compound, for instance, the deterioration of photosensitivity and the increase of the residual potential can be minimized.

Specific examples of such a hindered phenol compound for use in the present invention are 2,6-di-tert-butylphenol, 2,6-tert-butyl-4-methoxyphenol, 2,6-di-tert-butyl-4-methylphenol, 2-tert-butyl-4-methoxyphenol, 2,4-dimethyl-6-tert-butylphenol, butylhydroxyanisole, 2,2'-methylenebis (6-tert-butyl-4-methylphenol), 2-tert-butyl- 6-(3'-tert-butyl-5'-methyl-2'-hydroxybenzyl)-4-methylphenylacrylate, 4,4'-butylidene-bis(3-methyl-6-tert-butylphenol), n-octadecyl-3-(3',5'-di-tert-butyl-4'-hydroxyphenyl)propionate, tetrakis [methylene-3(3,5-di-tert-butyl-4-hydroxyphenyl) propionate]methane, 1,1,3-tris (2-methyl-4-hydroxy-5-tert-butylphenyl)butane, and 1,3,5-trimethyl-2,4,6-tris(3,5-di-tert-butyl-4-hydroxybenzyl)benzene.

Furthermore, when the hydroquinone compound is used as the phenol compound in the present invention, the most preferable results can be obtained. This is because such a hydroquinone compound has a striking effect on the stabilization of the charging characteristics of the photoconductor.

Examples of the hydroquinone compound for use in the present invention are 2,5-di-tert-butylhydroquinone, 2,5-di-tert-pentylhydroquinone, 2,5-di-tert-hexylhydro-quinone, 2-methyl-5-(1-phenyl-tert-propyl)hydroquinone, 2-tert-butyl-5-(1-phenyl-tert-propyl)hydroquinone, 2-phenyl-5-(3-phenyl-tert-pentyl)hydroquinone, 2,6-di-tert-butylhydroquinone, and 2,6-di-tert-hexylhydroquinone.

For the organic sulfur-containing compound for use in the present invention, any conventional compounds can be employed. Particularly, dialkyl thioalkylated compounds are preferably used because the effect of such dialkyl thioalkylated compounds on the stabilization of the charging characteristics is impressive.

Specific examples of the dialkyl thioalkylated compound are dilauryl-3,3'-thiodipropionate, ditridecyl-3,3'-thiodipropionate, dimyristyl-3,3'-thiodipropionate, distearyl-3,3'-thiodipropionate, distearyl-3,3'-methyl-3,3'-thiodipropionate, lauryl-3,3'-thiodipropionate, lauryl-stearyl-3,3'-thiodipropionate, and pentaerythrityl-tetrakis(3-laurylthiopropionate).

It is preferable that the amount of the mixture comprising the phenol compound and the organic sulfur-containing compound be in the range of 0.1 to 2 parts by weight to 10 parts by weight of the binder resin. When the amount of the mixture is within the above-mentioned range, the mixture can bring about the desired effect on the improvement of the charging stability without the decrease of photosensitivity and the increase of residual potential.

Furthermore, it is preferable that the mixture comprise the phenol compound and the organic sulfur-containing compound at a ratio by weight of 1:10 to 10:1. When the mixing ratio is within the above range, the charging stability during the repeated operations, in particular, the durability of the photoconductor with respect to the oxidizing gases such as ozone and NOx is remarkably improved.

Specific examples of the organic charge generation material for use in the present invention are as follows: C.I. Pigment Blue 25 (C.I. 21180), C.I. Pigment Red 41 (C.I. 21200), C.I. Acid Red 52 (C.I. 45100), C.I. Basic Red 3 (C.I. 45210), a phthalocyanine pigment having a porphyrin skeleton, an azulenium salt pigment, a squaric salt pigment, an azo pigment having a carbazole skeleton (Japanese Laid-Open Patent Application 53-95033), an azo pigment having a styryl stilbene skeleton (Japanese Laid-Open Patent Application 53-138229), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-17734), a trisazo pigment having a carbazole skeleton (Japanese Laid-Open Patent Applications 57-195767 and 57-195768), a phthalocyanine pigment such as C.I. Pigment Blue 16 (C.I. 74100), an indigo pigment such as C.I. Vat Brown 5 (C.I. 73410) and C.I. Vat Dye (C.I. 73030), a perylene pigment such as Algol Scarlet B and Indanthrene Scarlet R (made by Bayer Co., Ltd.), an anthraquinone pigment or polycyclic quitone pigment, a quinoneimine pigment, a diphenylmethane pigment and a triphenylmethane pigment, a benzoquinone pigment and a naphthoquinone pigment, a cyanine pigment and an azomethine pigment, and a bisbenzimidazole pigment.

It is preferable that the amount of the above-mentioned charge generation material be in the range of 0.1 to 10 parts by weight to 10 parts by weight of the binder resin. When the amount of the charge generation material is within the above range, the increase of the residual potential can be minimized, and the charging characteristics and the mechanical strength of the photoconductive layer can be maintained in good condition.

Examples of the charge transport material for use in the present invention include oxazole derivatives, imidazole derivatives, triphenylamine derivatives, and the following compounds represented by formulae (1) to (19):

[Compound of Formula (1)]

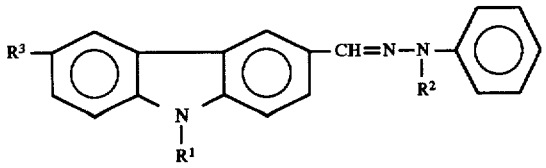

(1)

wherein $R^1$ is methyl group, ethyl group, 2-hydroxyethyl group, or 2-chloroethyl group; $R^2$ is methyl group, ethyl group, benzyl group, or phenyl group; and $R^3$ is a hydrogen atom, a chlorine atom, a bromine atom, an alkyl group having 1 to 4 carbon atoms, an alkoxyl group having 1 to 4 carbon atoms, a dialkylamino group, or nitro group.

Examples of the above compound of formula (1) are 9-ethylcarbazole-3-aldehyde-1-methyl-1-phenylhydrazone, 9-ethylcarbazole-3-aldehyde-1-benzyl-1-phenylhydrazone, and 9-ethylcarbazole-3-aldehyde-1,1-diphenylhydrazone.

[Compound of Formula (2)]

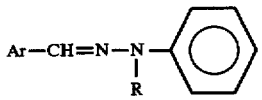

(2)

wherein Ar is naphthalene ring, anthracene ring, styryl ring, each of which may have a substituent, pyridine ring, furan ring, or thiophene ring; and R is an alkyl group or benzyl group.

Examples of the above compound of formula (2) are 4-diethylaminostyryl-3-aldehyde-1-methyl-1-phenylhydrazone, and 4-methoxynaphthalene-1-aldehyde-1-benzyl-1-phenylhydrazone.

[Compound of Formula (3)]

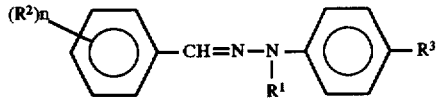

(3)

wherein $R^1$ is an alkyl group, benzyl group, phenyl group, or naphthyl group; $R^2$ is a hydrogen atom, an alkyl group having 1 to 3 carbon atoms, an alkoxyl group having 1 to 3 carbon atoms, a dialkylamino group, a diaralkylamino group, or a diarylamino group; n is an integer of 1 to 4, and when n is 2 or more, $R^2$ may be the same or different; and $R^3$ is a hydrogen atom or methoxy group.

Examples of the above compound of formula (3) are 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-benzyl-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

[Compound of Formula (4)]

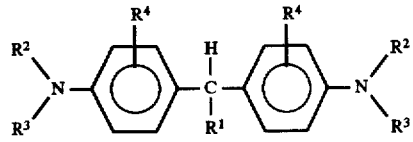

(4)

wherein $R^1$ is an alkyl group having 1 to 11 carbon atoms, a substituted or unsubstituted phenyl group, or a heterocyclic group; $R^2$ and $R^3$ which may be the same or different, each is a hydrogen atom, an alkyl group having 1 to 4 carbon atoms, a hydroxyalkyl group, chloroalkyl group, or a substituted or unsubstituted aralkyl group, and $R^2$ and $R^3$ may form a nitrogen-containing heterocyclic ring in combination; and $R^4$, which may be the same or different, each is a hydrogen atom, an alkyl group having 1 to 4 carbon atoms, an alkoxyl group, or a halogen atom.

Examples of the above compound of formula (4) are 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)-triphenylmethane.

[Compound of Formula (5)]

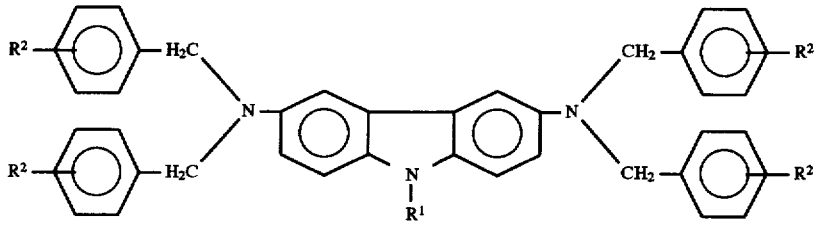

(5)

wherein $R^1$ is a hydrogen atom, a substituted or unsubstituted alkyl group, or phenyl group; and $R^2$ is a hydrogen atom, a substituted or unsubstituted alkyl group, an alkoxyl group, or a halogen atom.

Examples of the above compound of formula (5) include N-ethyl-3,6-tetrabenzylaminocarbazole.

[Compound of Formula (6)]

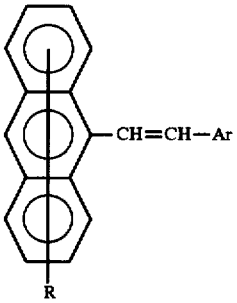

(6)

wherein R is a hydrogen atom or a halogen atom; and Ar is a substituted or unsubstituted phenyl group, naphthyl group, anthryl group, or carbazolyl group.

Examples of the above compound of formula (6) are 9-(4-diethylaminostyryl)anthracene, and 9-bromo-10-(4-diethylaminostyryl)anthracene.

[Compound of Formula (7)]

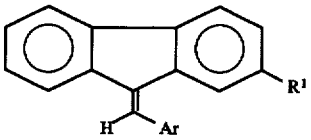

(7)

wherein $R^1$ is a hydrogen atom, a halogen atom, cyano group, an alkoxyl group having 1 to 4 carbon atoms, or an alkyl group having 1 to 4 carbon atoms; and Ar is

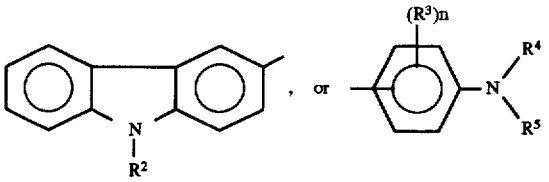

in which $R^2$ is an alkyl group having 1 to 4 carbon atoms; $R^3$ is a hydrogen atom, a halogen atom, an alkyl group having 1 to 4 carbon atoms, an alkoxyl group having 1 to 4 carbon atoms, or a dialkylamino group; n is an integer of 1 or 2, and when n is 2, $R^3$may be the same or different; and R4 and $R^5$ each is a hydrogen atom, a substituted or unsubstituted alkyl group having 1 to 4 carbon atoms, or a substituted or unsubstituted benzyl group. Examples of the above compound of formula (7) are 9-(4-dimethylaminobenzylidene)fluorene, and 3-(9-fluorenylidene)-9-ethylcarbazole.

[Compound of Formula (8)]

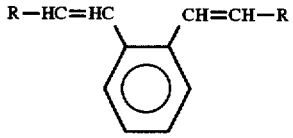

(8)

wherein R is carbazolyl group, pyridine group, thienyl group, indolyl group, furyl group, a substituted or unsubstituted phenyl group, a substituted or unsubstituted styryl group, a substituted or unsubstituted naphthyl group, or a substituted or unsubstituted anthryl group, each of which may have a substituent selected from the group consisting of a dialkylamino group, an alkyl group, an alkoxyl group, carboxyl group and an ester group thereof, a halogen atom, cyano group, an aralkylamino group, an N-alkyl-N-aralkylamino group, amino group, nitro group and acetylamino group.

Examples of the above compound of formula (8) are 1,2-bis(4-diethylaminostyryl)benzene, and 1,2-bis(2,4-dimethoxystyryl)benzene.

[Compound of Formula (9)]

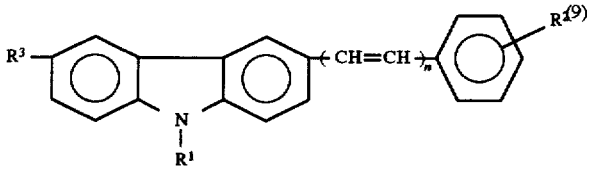

(9)

wherein $R^1$ is a lower alkyl group, substituted or unsubstituted phenyl group, or benzyl group; $R^2$ and $R^3$ each is a hydrogen atom, a lower alkyl group, a lower alkoxyl group, a halogen atom, nitro group, an amino group which may have as a substituent a lower alkyl group or benzyl group; and n is an integer of 1 or 2.

Examples of the above compound of formula (9) are 3-styryl-9-ethylcarbazole, and 3-(4-methoxystyryl)-9-ethylcarbazole.

[Compound of Formula (10)]

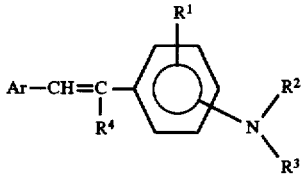

(10)

wherein $R^1$ is a hydrogen atom, an alkyl group, an alkoxyl group, or a halogen atom; $R^2$ and $R^3$ each is an alkyl group, a substituted or unsubstituted aralkyl group, or a substituted or unsubstituted aryl group; $R^4$ is a hydrogen atom, or a substituted or unsubstituted phenyl group; and Ar is a substituted or unsubstituted phenyl group, or a substituted or unsubstituted naphthyl group.

Examples of the above compound of formula (10) are 4-diphenylaminostilbene, 4-dibenzylaminostilbene, 4-ditolylaminostilbene, 1-(4-diphenylaminostyryl) naphthalene, and 1-(4-diethylaminostyryl)naphthalene.

[Compound of Formula (11)]

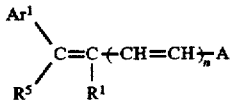

(11)

wherein n is an integer of 0 or 1, and when n=0, A and $R^1$ may form a ring in combination; $R^1$ is a hydrogen atom, an alkyl group, or a substituted or unsubstituted phenyl group; $Ar^1$ is a substituted or unsubstituted aryl group; $R^5$ is a substituted or unsubstituted alkyl group, or a substituted or unsubstituted aryl group; and A is 9-anthryl group, a substituted or unsubstituted carbazolyl group, or

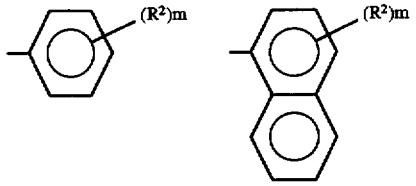

in which m is an integer of 0 to 3, and when m is 2 or more, $R^2$ may be the same or different; and $R^2$ is a hydrogen atom, an alkyl group, an alkoxyl group, a halogen atom, or

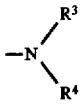

in which $R^3$ and $R^4$, which may be the same or different, each is an alkyl group, a substituted or unsubstituted aralkyl group, or a substituted or unsubstituted aryl group, and $R^3$ and $R^4$ may form a ring in combination.

Examples of the above compound of formula (11) are 4'-diphenylamino-α-phenylstilbene, and 4'-bis (methylphenyl) amino-α-phenylstilbene.

[Compound of Formula (12)]

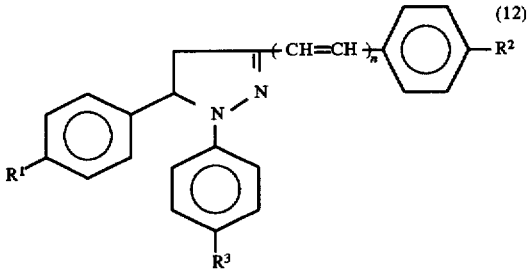

(12)

wherein $R^1$, $R^2$ and $R^3$ each is a hydrogen atom, a lower alkyl group, a lower alkoxyl group, a dialkylamino group, or a halogen atom; and n is an integer of 0 or 1.

Examples of the above compound of formula (12) are 1-phenyl-3-(4-diethylaminostyryl)-5-(4-diethylaminophenyl) pyrazoline, and 1-phenyl-3-(4-dimethylaminostyryl)-5-(4-dimethylaminophenyl) pyrazoline.

[Compound of Formula (13)]

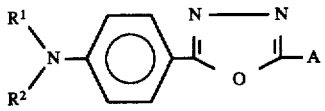

(13)

wherein $R^x$ and $R^2$ each is a substituted or unsubstituted alkyl group, or s substituted or unsubstituted aryl group; and A is a substituted amino group, a substituted or unsubstituted aryl group, or an allyl group.

Examples of the above compound of formula (13) are 2,5-bis(4-diethylaminophenyl)-1,3,4-oxadiazole, 2-N, N-diphenylamino-5-(4-diethylaminophenyl)-1,3,4-oxadiazole, and 2-(4-dimethylaminophenyl)-5-(4-diethylaminophenyl)-1,3,4-oxadiazole.

[Compound of Formula (14)]

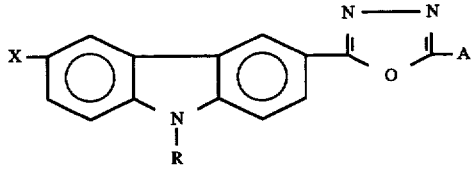

(14)

wherein x is a hydrogen atom, a lower alkyl group, or a halogen atom; R is a substituted or unsubstituted alkyl group, or a substituted or unsubstituted aryl group; and A is a substituted amino group, or a substituted or unsubstituted aryl group.

Examples of the above compound of formula (14) are 2-N,N-diphenylamino-5-(N-ethylcarbazole-3-yl)-1,3,4-oxadiazole, and 2-(4-diethylaminophenyl)-5-(N-ethylcarbazole-3-yl)-1,3,4-oxadiazole.

[Compound of Formula (15)]

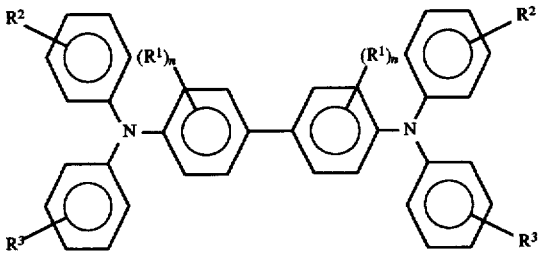

(15)

wherein $R^1$ is a lower alkyl group, a lower alkoxyl group, or a halogen atom; n is an integer of 0 to 4; and $R^2$ and $R^3$, which may be the same or different, each is a hydrogen atom, a lower alkyl group, a lower alkoxyl group, or a halogen atom.

Examples of the benzidine compound of formula (15) are N,N'-diphenyl-N,N'-bis(3-methylphenyl)-[1,1'-biphenyl]-4,4'-diamine, and 3,3'-dimethyl-N,N,N',N'-tetrakis (4-methylphenyl)-[1,1'-biphenyl]-4,4'-diamine.

[Compound of Formula (16)]

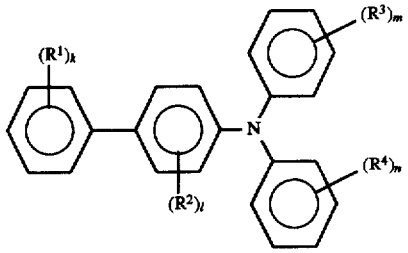

(16)

wherein $R^1$ $R^3$ and $R^4$ each is a hydrogen atom, amino group, an alkoxyl group, a thioalkoxyl group, an aryloxy group, methylenedioxy group, a substituted or unsubstituted alkyl group, a halogen atom, or a substituted or unsubstituted aryl group; $R^2$ is a hydrogen atom, an alkoxyl group, a substituted or unsubstituted alkyl group, or a halogen atom, provided $R^1$, $R^2$, $R^3$ and $R^4$ are not hydrogen atoms at the same time; and k, l, m and n each is an integer of 1 to 4, and when each is an integer of 2, 3 or 4, each of $R^1$, $R^2$, $R^3$ and $R^4$ may be the same or different.

Examples of the biphenylamine compound of formula (16) are 4'-methoxy-N,N-diphenyl-[1,1'-biphenyl]-4-amine, 4'-methyl-N,N'-bis(4-methylphenyl)-[1,1'-biphenyl]-4-amine, and 4'-methoxy-N,N'-bis(4-methylphenyl)-[1,1'-biphenyl]-4-amine.

[Compound of Formula (17)]

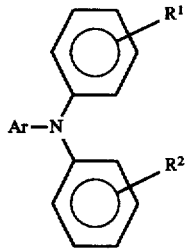

(17)

wherein Ar is a condensed polycyclic hydrocarbon group having 18 or less carbon atoms; and $R^1$ and $R^2$, which may be the same or different, each is a hydrogen atom, a halogen atom, a substituted or unsubstituted alkyl group, an alkoxyl group, or a substituted or unsubstituted phenyl group.

Examples of the triarylamine compound of formula (17) are 1-phenylaminopyrene, and 1-di(p-tolylamino)pyrene.

[Compound of Formula (18)]

$$A—CH=CH—Ar—CH=CH—A \quad (18)$$

wherein Ar is a substituted or unsubstituted aromatic hydrocarbon group; and A is

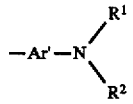

in which Ar' is a substituted or unsubstituted aromatic hydrocarbon group; and $R^1$ and $R^2$ each is a substituted or unsubstituted alkyl group, or a substituted or unsubstituted aryl group. Examples of the diolefin aromatic compound of formula (18) are 1,4-bis(4-diphenylaminostyryl)benzene, and 1,4-bis[4-di(p-tolyl)aminostyryl]benzene.

[Compound of Formula (19)]

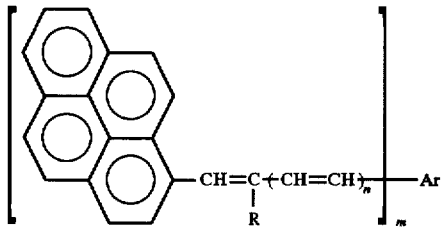

(19)

wherein Ar is an aromatic hydrocarbon group; R is a hydrogen atom, a substituted or unsubstituted alkyl group, or a substituted or unsubstituted aryl group; and n is an integer of 0 or 1, and m is an integer of 1 or 2, and when n=0 and m=1, Ar and R may form a ring in combination.

Examples of the styrylpyrene compound of formula (19) are 1-(4-diphenylaminostyryl)pyrene, and 1-[4-di(p-tolyl) aminostyryl]pyrene.

Those charge transport materials can be used alone or in combination.

Of the above-mentioned charge transport materials, the charge transport material with an oxidation potential of +0.5 V or more (vs SCE) is preferably employed in the single-layered photoconductive layer because the charging characteristics and the photosensitivity of the photoconductor are further improved.

In the present invention, the above-mentioned oxidation potential of the charge transport material is expressed by a half wave potential measured according to the cyclic voltammetry. The measurement is carried out at room temperature using acetonitrile as a solvent, 0.1 M of tetraethylammonium perchlorate (TEAP) as an electrolyte, and a saturated calomel electrode (SCE) as a reference electrode.

The previously mentioned charge transport materials, which have the positive-hole transporting properties, can be used alone or in combination. Further, to optimize the photosensitivity and reduce the residual potential, the previously mentioned charge transport materials with the positive-hole transporting properties may be used in combination with electron-acceptor compounds with the electron-transporting properties.

Specific examples of the above-mentioned electron-acceptor compound are chloroanil, bromoanil, tetracyanoethylene, tetracyanoquinone dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, and 1,3,7-trinitrodibenzothiophene-5,5-dioxide.

It is preferable that the amount of the charge transport material be in the range of 1 to 15 parts by weight to 10 parts by weight of the binder resin. When the amount of the charge transport material is within the above-mentioned range, sufficient photosensitivity can be obtained, and the deterioration of the charging characteristics and the mechanical strength can be prevented.

Any binder agent for use in the conventional electrophotographic photoconductors can be used in the present invention. A polymer with insulating properties and excellent film-forming properties is preferably employed as a binder resin.

Examples of the binder resin for use in the present invention include thermoplastic and thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, polycarbonate (bisphenol A type and bisphenol Z type), cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, and alkyd resin.

As the material for the electroconductive support, there can be employed metals or alloys such as aluminum, brass, stainless steel, and nickel; a composite material prepared by providing a thin layer made of metals such as aluminum, silver, gold and nickel, or electroconductive materials such as indium oxide and tin oxide on an insulating support member such as a polyethylene terephthalate film, polypropylene film, nylon sheet, glass plate or a sheet of paper; a resin molded into a film in which electroconductive particles of carbon black, indium oxide, or tin oxide are dispersed; and a sheet of paper which has been treated to be electroconductive. The form of the electroconductive support is not specifically limited, and a sheet-shaped, drum-shaped, or belt-shaped electroconductive support is available.

The present invention will now be explained in detail by referring to FIG. 1 to FIG. 4.

In an electrophotographic photoconductor as shown in FIG. 1, a single-layered photoconductive layer 2 is provided on an electroconductive support 1.

Figure 2:
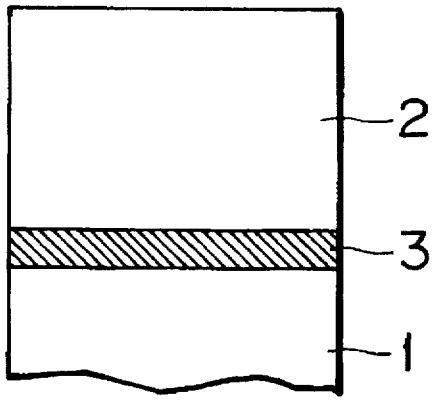
FIG. 2 is a schematic cross-sectional view of a second example of an electrophotographic photoconductor according to the present invention.

In an electrophotographic photoconductor as shown in FIG. 2, there is provided an intermediate layer 3 between an electroconductive support 1 and a single-layered photoconductive layer 2 in order to increase the adhesion of the photoconductive layer 2 to the electroconductive support 1 and improve the charge blocking properties.

Figure 3:
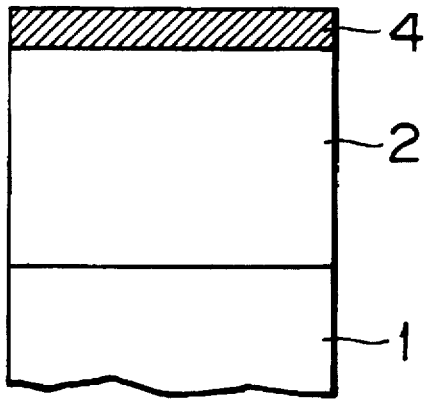
FIG. 3 is a schematic cross-sectional view of a third example of an electrophotographic photoconductor according to the present invention.

Further, a protective layer 4 may be provided on a single-layered photoconductive layer 2 as shown in FIG. 3 to improve the mechanical durability such as wear resistance of the photoconductor.

Figure 4:
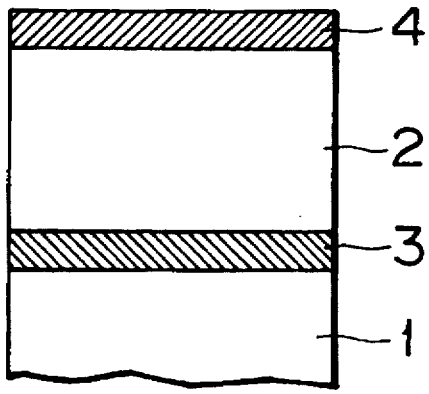
FIG. 4 is a schematic cross-sectional view of a fourth example of an electrophotographic photoconductor according to the present invention.

An electrophotographic photoconductor as shown in FIG. 4 comprises an electroconductive support 1, and an intermediate layer 3, a single-layered photoconductive layer 2 and a protective layer 4 which are successively overlaid on the electroconductive support 1.

To fabricate the electrophotographic photoconductor according to the present invention, the charge generation material, the charge transport material, the binder resin, the phenol compound and the organic sulfur-containing compound are dispersed and/or dissolved in a proper solvent to prepare a coating liquid for the photoconductive layer. The thus prepared coating liquid may be coated on the electroconductive support by dip coating, spray coating or bead coating method. A solvent used in the preparation of the coating liquid may be appropriately selected depending on the employed coating method, the solubilities of the above-mentioned components, the affinities of the components for the employed solvent. There can be employed ketones, esters, alcohols, cyclic ethers, cyclic ketones, halogenated solvents.

It is preferable that the thickness of the single-layered photoconductive layer be in the range of 5 to 100 μm, more preferably in the range of 10 to 50 μm. When the thickness of the photoconductive layer is in the range of 5 to 100 μm, the mechanical strength of the photoconductive layer is sufficient, and the increase of the residual potential can be prevented.

Other features of this invention will become apparent in the course of the following description of exemplary embodiments, which are given for illustration of the invention and are not intended to be limiting thereof.

EXAMPLE 1

10 parts by weight of a disazo pigment of formula (20) serving as a charge generation material and 100 parts by weight of tetrahydrofuran were dispersed in a ball mill for 5 days.

The above prepared dispersion of the disazo pigment was added to a mixture of the following components:

| | Parts by Weight |
|---|---|
| Z type polycarbonate resin with a molecular weight of 40,000 | 100 |
| Tetrahydrofuran | 600 |
| Stilbene derivative of formula (21) serving as a charge transport material | 80 |
| 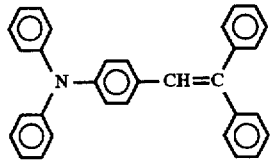 | (21) |
| 2,5-di-tert-butylhydroquinone | 5 |
| dilauryl-3,3'-thiodipropionate (Trademark "SUMILIZER TPL-R", made by Sumitomo Chemical Co., Ltd.) | 5 |
| Silicone oil (Trademark "KF-50", made by Shin-Etsu Chemical Co., Ltd.) | 0.1 |

The thus obtained mixture was further dispersed in a ball mill for one day, so that a coating liquid for a photoconductive layer was prepared.

The coating liquid thus prepared was coated on an aluminum plate with a thickness of 0.2 mm (Trademark "A1080", made by Sumitomo Light Metal Industries, Ltd.) by blade coating method, and dried at 130° C. for 20 minutes, so that a single-layered photoconductive layer with a thickness of 20 μm was provided on the aluminum plate.

Thus, an electrophotographic photoconductor No. 1 according to the present invention was obtained.

EXAMPLE 2

The procedure for preparation of the electrophotographic photoconductor No. 1 according to the present invention in Example 1 was repeated except that the amounts of 2,5-di-tert-butylhydroquinone (phenol compound) and dilauryl-3,3'-thiodipropionate (organic sulfur-containing compound) used in the coating liquid for the photoconductive layer in Example 1 were changed to 2.5 parts by weight.

Thus, an electrophotographic photoconductor No. 2 according to the present invention was obtained.

EXAMPLE 3

The procedure for preparation of the electrophotographic photoconductor No. 1 according to the present invention in Example 1 was repeated except that the amounts of 2,5-di-tert-butylhydroquinone (phenol compound) and dilauryl-3,

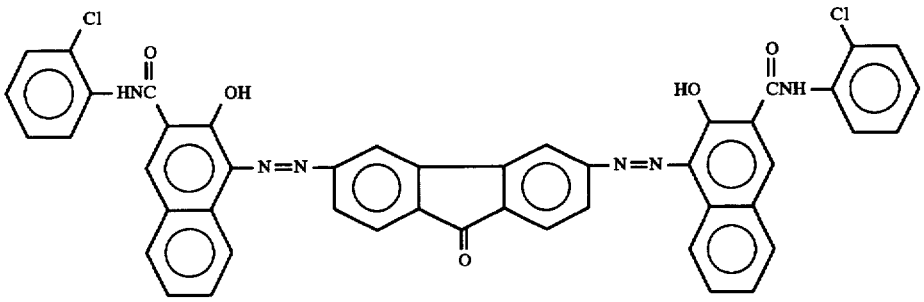

(20)

3'-thiodipropionate (organic sulfur-containing compound) used in the coating liquid for the photoconductive layer in Example 1 were changed to 0.5 parts by weight.

Thus, an electrophotographic photoconductor No. 3 according to the present invention was obtained.

EXAMPLE 4

The procedure for preparation of the electrophotographic photoconductor No. 1 according to the present invention in Example 1 was repeated except that the amounts of 2,5-di-tert-butylhydroquinone (phenol compound) and dilauryl-3,3'-thiodipropionate (organic sulfur-containing compound) used in the coating liquid for the photoconductive layer in Example 1 were changed to 10 parts by weight.

Thus, an electrophotographic photoconductor No. 4 according to the present invention was obtained.

EXAMPLE 5

The procedure for preparation of the electrophotographic photoconductor No. 1 according to the present invention in Example 1 was repeated except that the amounts of 2,5-di-tert-butylhydroquinone (phenol compound) and dilauryl-3,3'-thiodipropionate (organic sulfur-containing compound) used in the coating liquid for the photoconductive layer in Example 1 were changed to 15 parts by weight.

Thus, an electrophotographic photoconductor No. 5 according to the present invention was obtained.

EXAMPLE 6

The procedure for preparation of the electrophotographic photoconductor No. 1 according to the present invention in Example 1 was repeated except that the amount of 2,5-di-tert-butylhydroquinone (phenol compound) used in the coating liquid for the photoconductive layer in Example 1 was changed to 0.05 parts by weight, and that the amount of dilauryl-3,3'-thiodipropionate (organic sulfur-containing compound) used in the coating liquid for the photoconductive layer in Example 1 was changed to 9.95 parts by weight.

Thus, an electrophotographic photoconductor No. 6 according to the present invention was obtained.

EXAMPLE 7

The procedure for preparation of the electrophotographic photoconductor No. 1 according to the present invention in Example 1 was repeated except that the amount of 2,5-di-tert-butylhydroquinone (phenol compound) used in the coating liquid for the photoconductive layer in Example 1 was changed to 0.1 parts by weight, and that the amount of dilauryl-3,3'-thiodipropionate (organic sulfur-containing compound) used in the coating liquid for the photoconductive layer in Example 1 was changed to 9.9 parts by weight.

Thus, an electrophotographic photoconductor No. 7 according to the present invention was obtained.

EXAMPLE 8

The procedure for preparation of the electrophotographic photoconductor No. 1 according to the present invention in Example 1 was repeated except that the amount of 2,5-di-tert-butylhydroquinone (phenol compound) used in the coating liquid for the photoconductive layer in Example 1 was changed to 9.9 parts by weight, and that the amount of dilauryl-3,3'-thiodipropionate (organic sulfur-containing compound) used in the coating liquid for the photoconductive layer in Example 1 was changed to 0.1 parts by weight.

Thus, an electrophotographic photoconductor No. 8 according to the present invention was obtained.

EXAMPLE 9

The procedure for preparation of the electrophotographic photoconductor No. 1 according to the present invention in Example 1 was repeated except that the amount of 2,5-di-tert-butylhydroquinone (phenol compound) used in the coating liquid for the photoconductive layer in Example 1 was changed to 9.95 parts by weight, and that the amount of dilauryl-3,3'-thiodipropionate (organic sulfur-containing compound) used in the coating liquid for the photoconductive layer in Example 1 was changed to 0.05 parts by weight.

Thus, an electrophotographic photoconductor No. 9 according to the present invention was obtained.

EXAMPLE 10

The procedure for preparation of the electrophotographic photoconductor No. 1 according to the present invention in Example 1 was repeated except that the amount of the disazo pigment of formula (20) serving as the charge generation material in Example 1 was changed to 0.5 parts by weight.

Thus, an electrophotographic photoconductor No. 10 according to the present invention was obtained.

EXAMPLE 11

The procedure for preparation of the electrophotographic photoconductor No. 1 according to the present invention in Example 1 was repeated except that the amount of the disazo pigment of formula (20) serving as the charge generation material in Example 1 was changed to one part by weight.

Thus, an electrophotographic photoconductor No. 11 according to the present invention was obtained.

EXAMPLE 12

The procedure for preparation of the electrophotographic photoconductor No. 1 according to the present invention in Example 1 was repeated except that the amount of the disazo pigment of formula (20) serving as the charge generation material in Example 1 was changed to 100 parts by weight.

Thus, an electrophotographic photoconductor No. 12 according to the present invention was obtained.

EXAMPLE 13

The procedure for preparation of the electrophotographic photoconductor No. 1 according to the present invention in Example 1 was repeated except that the amount of the disazo pigment of formula (20) serving as the charge generation material in Example 1 was changed to 150 parts by weight.

Thus, an electrophotographic photoconductor No. 13 according to the present invention was obtained.

EXAMPLE 14

The procedure for preparation of the electrophotographic photoconductor No. 1 according to the present invention in Example 1 was repeated except that the amount of the stilbene derivative of formula (21) serving as the charge transport material in Example 1 was changed to 5 parts by weight.

Thus, an electrophotographic photoconductor No. 14 according to the present invention was obtained.

EXAMPLE 15

The procedure for preparation of the electrophotographic photoconductor No. 1 according to the present invention in Example 1 was repeated except that the amount of the stilbene derivative of formula (21) serving as the charge transport material in Example 1 was changed to 10 parts by weight.

Thus, an electrophotographic photoconductor No. 15 according to the present invention was obtained.

EXAMPLE 16

The procedure for preparation of the electrophotographic photoconductor No. 1 according to the present invention in Example 1 was repeated except that the amount of the stilbene derivative of formula (21) serving as the charge transport material in Example 1 was changed to 150 parts by weight.

Thus, an electrophotographic photoconductor No. 16 according to the present invention was obtained.

EXAMPLE 17

The procedure for preparation of the electrophotographic photoconductor No. 1 according to the present invention in Example 1 was repeated except that the amount of the stilbene derivative of formula (21) serving as the charge transport material in Example 1 was changed to 200 parts by weight.

Thus, an electrophotographic photoconductor No. 17 according to the present invention was obtained.

Comparative Example 1

The procedure for preparation of the electrophotographic photoconductor No. 1 according to the present invention in Example 1 was repeated except that 2,5-di-tert-butylhydroquinone (phenol compound) was not added to the composition of the coating liquid for the single-layered photoconductive layer in Example 1, and than the amount of dilauryl-3,3'-thiodipropionate (organic sulfur-containing compound) was changed to 10 parts by weight.

Thus, a comparative electrophotographic photoconductor No. 1 was obtained.

Comparative Example 2

The procedure for preparation of the electrophotographic photoconductor No. 1 according to the present invention in Example 1 was repeated except that dilauryl-3,3'-thiodipropionate (organic sulfur-containing compound) was not added to the composition of the coating liquid for the single-layered photoconductive layer in Example 1, and that the amount of 2,5-di-tert-butylhydroquinone (phenol compound) was changed to 10 parts by weight.

Thus, a comparative electrophotographic photoconductor No. 2 was obtained.

Comparative Example 3

The procedure for preparation of the electrophotographic photoconductor No. 1 according to the present invention in Example 1 was repeated except that neither 2,5-di-tert-butylhydroquinone (phenol compound) nor dilauryl-3,3'-thiodipropionate (organic sulfur-containing compound) was added to the composition of the coating liquid for the single-layered photoconductive layer in Example 1.

Thus, a comparative electrophotographic photoconductor No. 3 was obtained.

Comparative Example 4

The procedure for preparation of the electrophotographic photoconductor No. 1 according to the present invention in Example 1 was repeated except that a mixture of 5 parts by weight of 2,5-di-tert-butyl hydroquinone (phenol compound) and 5 parts by weight of dilauryl-3,3'-thiodipropionate (organic sulfur-containing compound) for use in the coating liquid for the single-layered photoconductive layer in Example 1 was replaced by 10 parts by weight of a compound represented by the following formula (22) comprising both of the phenol structure and the sulfur structure in its molecule:

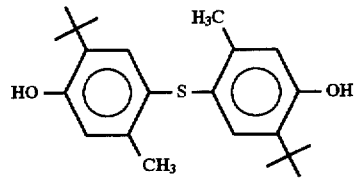

(22)

Thus, a comparative electrophotographic photoconductor No. 4 was obtained.

EXAMPLE 18

The procedure for preparation of the electrophotographic photoconductor No. 1 according to the present invention in Example 1 was repeated except that 2,5-di-tert-butylhydroquinone (phenol compound) for use in the coating liquid for the single-layered photoconductive layer in Example 1 was replaced by 1,3,5-trimethyl- 2,4,6-tris-(3,5-di-tert-butyl-4-hydroxybenzyl)benzene (Trademark "IRGANOX 1330", made by Ciba-Geigy, Ltd.), and that dilauryl-3,3'-thiodipropionate (organic sulfur-containing compound) for use in the coating liquid for the single-layered photoconductive layer in Example 1 was replaced by dimyristyl-3,3'-thiodipropionate (Trademark "SUMILIZER TPM", made by Sumitomo Chemical Co., Ltd.).

Thus, an electrophotographic photoconductor No. 18 according to the present invention was obtained.

EXAMPLE 19

The procedure for preparation of the electrophotographic photoconductor No. 1 according to the present invention in Example 1 was repeated except that 2,5-di-tert-butylhydroquinone (phenol compound) for use in the coating liquid for the single-layered photoconductive layer in Example 1 was replaced by tetrakis[methylene-3-(3,5-di-tert-butyl-4-hydroxyphenyl)propionate]methane (Trademark "SUMILIZER BP-101", made by Sumitomo Chemical Co., Ltd.), and that dilauryl-3,3'-thiodipropionate (organic sulfur-containing compound) for use in the coating liquid for the single-layered photoconductive layer in Example 1 was replaced by pentaerythrityl-tetrakis (3-lauryl thiopropionate) (Trademark "SUMILIZER TP-D", made by Sumitomo Chemical Co., Ltd.).

Thus, an electrophotographic photoconductor No. 19 according to the present invention was obtained.

EXAMPLE 20

The procedure for preparation of the electrophotographic photoconductor No. 1 according to the present invention in Example 1 was repeated except that 2,5-di-tert-butylhydroquinone (phenol compound) for use in the coating liquid for the single-layered photoconductive layer in Example 1 was replaced by pyrogallol.

Thus, an electrophotographic photoconductor No. 20 according to the present invention was obtained.

EXAMPLES 21 to 37

The procedure for preparation of the electrophotographic photoconductor No. 1 according to the present invention in Example 1 was repeated except that the stilbene derivative serving as the charge transport material for use in the coating liquid for the single-layered photoconductive layer in Example 1 was replaced by each compound as shown in Table 1.

Thus, electrophotographic photoconductors Nos. 21 to 37 according to the present invention were obtained.

In Table 1, the oxidation potential of each charge transport material is also shown.

TABLE 1

| | Charge Transport Material | Oxidation Potential [V(vs SCE)] |
|---|---|---|
| Ex. 1 | 4'-diphenylamino-α-phenylstilbene | 0.86 |
| Ex. 21 | 4'-(4-methoxy)diphenylamino-α-phenylstilbene | 0.74 |
| Ex. 22 | 9-ethylcarbazole-3-aldehyde-1-methyl-1-phenylhydrazone | 0.74 |
| Ex. 23 | 2-methoxynaphthalene-1-aldehyde-1-benzyl-1-phenylhydrazone | 0.79 |
| Ex. 24 | 3-(4-ethoxystyryl)-9-ethylcarbazole | 0.76 |
| Ex. 25 | 4-diphenylaminostilbene | 0.89 |
| Ex. 26 | N,N'-diphenyl-N,N'-bis(3-methylphenyl)-[1,1'-biphenyl]-4,4'-diamine | 0.73 |
| Ex. 27 | 4'-methoxy-N,N'-bis(4-methylphenyl)-[1,1'-biphenyl]-4-amine | 0.76 |
| Ex. 28 | N,N'-bis(4-methylphenyl)-[1,1'-biphenyl]-4-amine | 0.81 |
| Ex. 29 | 1-di(p-tolylamino)pyrene | 0.80 |
| Ex. 30 | 1,4-bis[4-di(p-tolyl)aminostyryl]-benzene | 0.89 |
| Ex. 31 | 4,4',4"-trimethoxytriphenylamine | 0.52 |
| Ex. 32 | 4,4-dimethyltriphenylamine | 0.84 |
| Ex. 33 | N-ethyl-3,6-tetrabenzylamino-carbazole | 0.31 |
| Ex. 34 | 1-phenyl-3-(4-diethylaminostyryl)-5-(4-diethylaminophenyl)pyrazoline | 0.47 |
| Ex. 35 | 1,3-diphenyl-5-(4-dimethylamino-phenyl)pyrazoline | 0.67 |
| Ex. 36 | 2,2'-dimethyl-4,4'-bis(diethylamino)triphenylmethane | 0.66 |
| Ex. 37 | 9-(4-diethylaminostyryl)anthracene | 0.52 |

EXAMPLE 38

10 parts by weight of a metal-free X type phthalocyanine pigment serving as a charge generation material (Trademark "FASTOGEN BLUE 8120B", made by Dainippon Ink & Chemicals, Incorporated), 50 parts by weight of Z type polycarbonate resin with a molecular weight of 40,000, and 300 parts by weight of tetrahydrofuran were dispersed in a ball mill for one day.

The above prepared dispersion of the metal-free phthalocyanine pigment was added to a mixture of the following components:

| | Parts by Weight |
|---|---|
| Z type polycarbonate resin with a molecular weight of 40,000 | 50 |
| Tetrahydrofuran | 400 |
| Hydrazone derivative of formula (23) serving as a charge transport material | 100 |

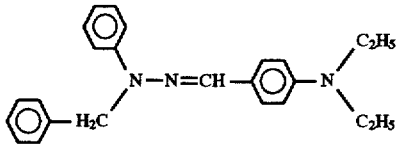

(23)

| | |
|---|---|
| 3,5-di-tert-butyl-4-hydroxytoluene | 5 |
| Lauryl-stearyl-3,3'-thiodipropionate | 5 |
| Silicone oil (Trademark "KF-50", made by Shin-Etsu Chemical Co., Ltd.) | 0.1 |

The thus obtained mixture was further dispersed in a ball mill for one day, so that a coating liquid for a photoconductive layer was prepared.

The coating liquid thus prepared was coated on an aluminum plate with a thickness of 0.2 mm (Trademark "A1080", made by Sumitomo Light Metal Industries, Ltd.) by blade coating method, and dried at 130° C. for 20 minutes, so that a single-layered photoconductive layer with a thickness of 20 μm was provided on the aluminum plate.

Thus, an electrophotographic photoconductor No. 38 according to the present invention was obtained.

EXAMPLE 39

10 parts by weight of a trisazo pigment of formula (24) serving as a charge generation material, 50 parts by weight of Z type polycarbonate resin with a molecular weight of 50,000, and 300 parts by weight of cyclohexanone were dispersed in a ball mill for 3 days.

(24)

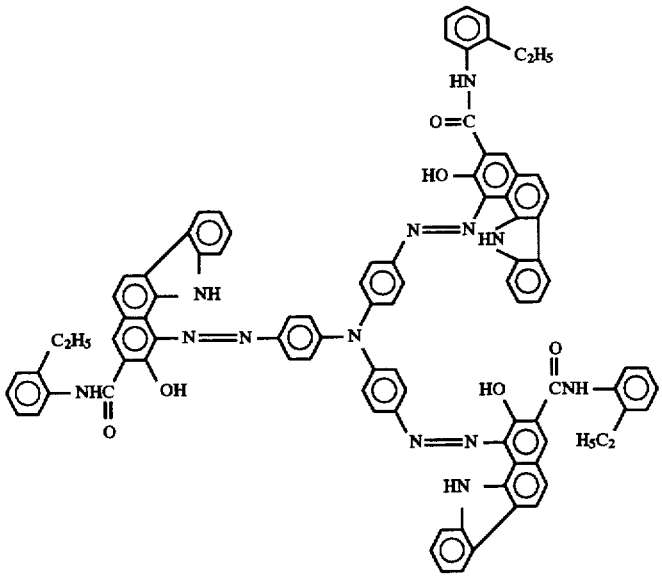

The above prepared dispersion of the trisazo pigment was added to a mixture of the following components:

| | Parts by Weight |
|---|---|
| Z type polycarbonate resin with a molecular weight of 50,000 | 50 |
| Tetrahydrofuran | 400 |
| Stilbene derivative of formula (25) serving as a charge transport material | 50 |
| 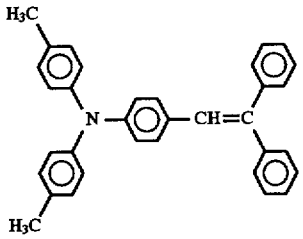 (25) | |
| 2-phenyl-5-(3-phenyl-tert-pentyl)hydroquinone | 5 |
| Distearyl-3,3'-thiodipropionate (Trademark "SUMILIZER TPS", made by Sumitomo Chemical Co., Ltd.) | 5 |
| Silicone oil (Trademark "KF-50", made by Shin-Etsu Chemical Co., Ltd.) | 0.1 |

The thus obtained mixture was further dispersed in a ball mill for one day, so that a coating liquid for a photoconductive layer was prepared.

The coating liquid thus prepared was coated on an aluminum plate with a thickness of 0.2 mm (Trademark "A1080", made by Sumitomo Light Metal Industries, Ltd.) by blade coating method, and dried at 160° C. for 40 minutes, so that a single-layered photoconductive layer with a thickness of 20 μm was provided on the aluminum plate.

Thus, an electrophotographic photoconductor No. 39 according to the present invention was obtained.

Comparative Example 5

The procedure for preparation of the electrophotographic photoconductor No. 38 according to the present invention in Example 38 was repeated except that neither 3,5-di-tert-butyl-4-hydroxytoluene (phenol compound) nor lauryl-stearyl-3,3'-thiodipropionate (organic sulfur-containing compound) was added to the composition of the coating liquid for the single-layered photoconductive layer in Example 38.

Thus, a comparative electrophotographic photoconductor No. 5 was obtained.

Comparative Example 6

The procedure for preparation of the electrophotographic photoconductor No. 39 according to the present invention in Example 39 was repeated except that neither 2-phenyl-5-(3-phenyl-tert-pentyl)hydroquinone (phenol compound) nor distearyl-3,3'-thiodipropionate (organic sulfur-containing compound) was added to the composition of the coating liquid for the single-layered photoconductive layer in Example 39.

Thus, a comparative electrophotographic photoconductor No. 6 was obtained.

[Evaluation Test 1]

The initial electrostatic characteristics of each of the electrophotographic photoconductors No. 1 through No. 39 according to the present invention obtained in Examples 1 to 39 and comparative electrophotographic photoconductors No. 1 through No. 6 obtained in Comparative Examples 1 to 6 were evaluated in a dynamic mode under the circumstances of 25° C. and 50% RH, using a commercially available electrostatic copying sheet testing apparatus ("Paper Analyzer Model EPA-8100" made by Kawaguchi Electro Works Co., Ltd.).

To be more specific, each photoconductor was charged positively in the dark under application of +6 kV for 20 seconds. Then, each electrophotographic photoconductor was allowed to stand in the dark for 20 seconds without applying any charge thereto. Each photoconductor was then illuminated by white light of a tungsten halogen lamp for 30 seconds in such a manner that the illuminance on the illuminated surface of the photoconductor was 10 lux. For obtaining the charging potential of each photoconductor, the saturated surface potential Vm (V) was measured 20 seconds after charging. For evaluating the sensitivity of each photoconductor, the exposure $E_{1/2}$ (lux·sec) required to reduce the surface potential obtained just before the light exposure to 2/1 the surface potential was measured. In addition, for the evaluation of the residual potential, the surface potential $V_{30}$ (V) of each photoconductor was measured 30 seconds after the completion of light exposure.

Table 2 shows the ratio by weight of the charge generation material to the binder resin, the ratio by weight of the charge transport material to the binder resin, the ratio by weight of the phenol compound to the binder resin, and the ratio by weight of the organic sulfur-containing compound to the binder resin in each coating liquid for the single-layered photoconductive layer. Further, the results of the previously mentioned Evaluation Test 1 are shown in Table 3.

[Evaluation Test 2]

Using each of the electrophotographic photoconductors, the same process of charging and exposure to white light as employed in the Evaluation Test 1 was repeated 5,000 times. After the repetition of the above-mentioned process, the charging potential Vm', the sensitivity $E_{1/2}$' and the residual potential $V_{30}$' were measured to evaluate the stability of the electrostatic characteristics after fatigue.

The results are shown in Table 3.

[Evaluation Test 3]

After each electrophotographic photoconductor was subjected to the Evaluation Test 1, namely, the process of charging and exposure to white light, the photoconductor was placed into a desiccator which was controlled so that the concentration of nitrogen monoxide (NO) was 20 ppm and that of nitrogen dioxide ($NO_2$) was 5 ppm, and allowed to stand in the dark for one day under the circumstances of 25° C. and 50% RH.

Thereafter, the photoconductor was taken out of the desiccator, and allowed to stand under the atmosphere for one day for dark adaptation. Then, the same process of charging and exposure to white light as employed in the Evaluation Test 1 was carried out, and the charging potential Vm", the sensitivity $E_{1/2}$" and the residual potential $V_{30}$" were measured to evaluate the stability of the electrostatic characteristics after exposure to the oxidizing gases.

The results are also shown in Table 3.

Figure 5:
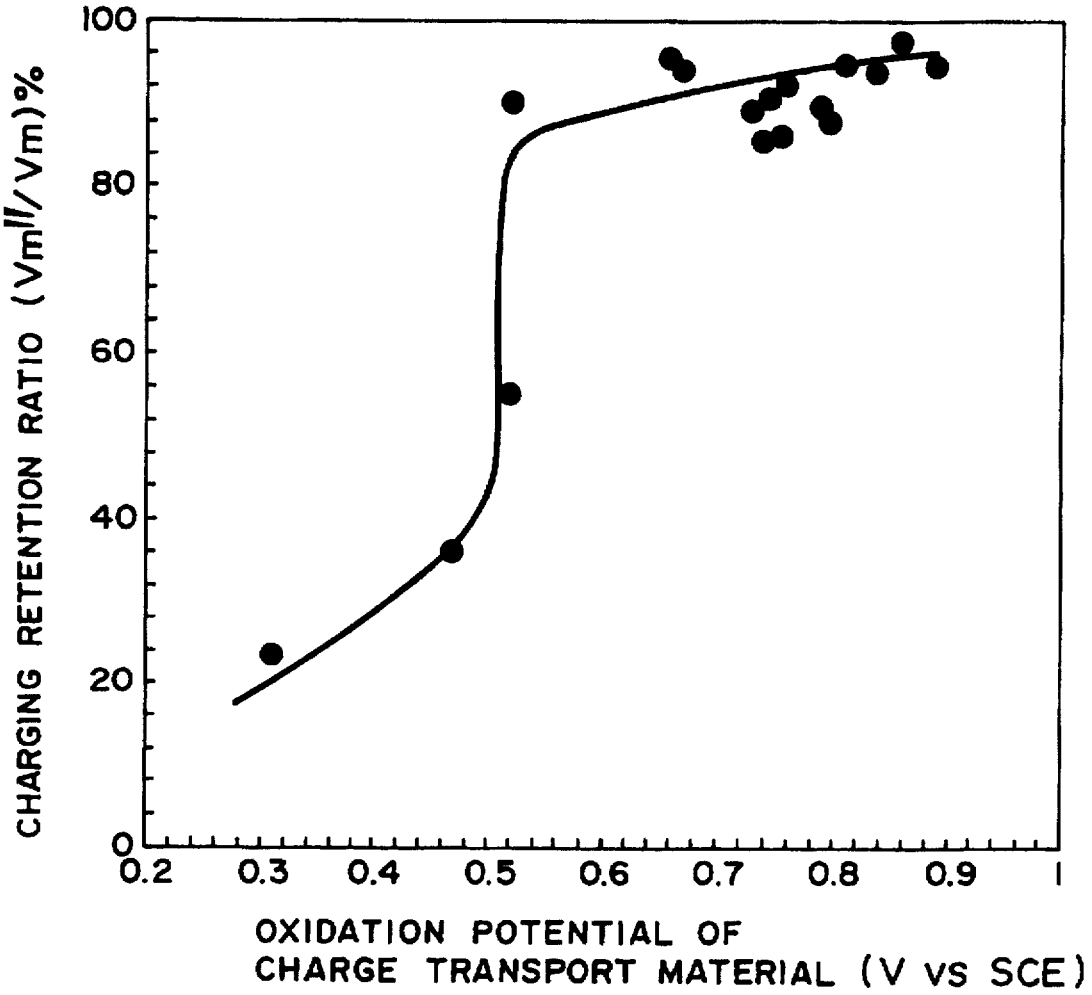
FIG. 5 is a graph which shows the relationship between the oxidation potential (vs SCE) of a charge transport material for use in the present invention and the charging retention ratio.

In addition, when the data obtained in Example 1 and Examples 21 to 37 were plotted, with charging retention ratio (Vm"/Vm) as ordinate and oxidation potential of the employed charge transport material as abscissa, the curve as shown in FIG. 5 was obtained.

TABLE 2

| | Ratio of CGM(*) to Binder Resin | Ratio of CTM(**) to Binder Resin | Ratio of Phenol Compound to Binder Resin | Ratio of Organic Sulfur-containing Compound to Binder Resin |
|---|---|---|---|---|
| Ex. 1 | 1/10 | 8/10 | 0.5/10 | 0.5/10 |
| Ex. 2 | 1/10 | 8/10 | 0.025/10 | 0.025/10 |
| Ex. 3 | 1/10 | 8/10 | 0.05/10 | 0.05/10 |
| Ex. 4 | 1/10 | 8/10 | 1/10 | 1/10 |
| Ex. 5 | 1/10 | 8/10 | 1.5/10 | 1.5/10 |
| Ex. 6 | 1/10 | 8/10 | 0.005/10 | 0.995/10 |
| Ex. 7 | 1/10 | 8/10 | 0.01/10 | 0.99/10 |
| Ex. 8 | 1/10 | 8/10 | 0.99/10 | 0.01/10 |
| Ex. 9 | 1/10 | 8/10 | 0.995/10 | 0.005/10 |
| Ex. 10 | 0.05/10 | 8/10 | 0.5/10 | 0.5/10 |

TABLE 2-continued

| | Ratio of CGM(*) to Binder Resin | Ratio of CTM(**) to Binder Resin | Ratio of Phenol Compound to Binder Resin | Ratio of Organic Sulfur-containing Compound to Binder Resin |
|---|---|---|---|---|
| Ex. 11 | 0.1/10 | 8/10 | 0.5/10 | 0.5/10 |
| Ex. 12 | 10/10 | 8/10 | 0.5/10 | 0.5/10 |
| Ex. 13 | 15/10 | 8/10 | 0.5/10 | 0.5/10 |
| Ex. 14 | 1/10 | 0.5/10 | 0.5/10 | 0.5/10 |
| Ex. 15 | 1/10 | 1/10 | 0.5/10 | 0.5/10 |
| Ex. 16 | 1/10 | 15/10 | 0.5/10 | 0.5/10 |
| Ex. 17 | 1/10 | 20/10 | 0.5/10 | 0.5/10 |
| Ex. 18 | 1/10 | 8/10 | 0.5/10 | 0.5/10 |
| Ex. 19 | 1/10 | 8/10 | 0.5/10 | 0.5/10 |
| Ex. 20 | 1/10 | 8/10 | 0.5/10 | 0.5/10 |
| Ex. 21 | 1/10 | 8/10 | 0.5/10 | 0.5/10 |
| Ex. 22 | 1/10 | 8/10 | 0.5/10 | 0.5/10 |
| Ex. 23 | 1/10 | 8/10 | 0.5/10 | 0.5/10 |
| Ex. 24 | 1/10 | 8/10 | 0.5/10 | 0.5/10 |
| Ex. 25 | 1/10 | 8/10 | 0.5/10 | 0.5/10 |
| Ex. 26 | 1/10 | 8/10 | 0.5/10 | 0.5/10 |
| Ex. 27 | 1/10 | 8/10 | 0.5/10 | 0.5/10 |
| Ex. 28 | 1/10 | 8/10 | 0.5/10 | 0.5/10 |
| Ex. 29 | 1/10 | 8/10 | 0.5/10 | 0.5/10 |
| Ex. 30 | 1/10 | 8/10 | 0.5/10 | 0.5/10 |
| Ex. 31 | 1/10 | 8/10 | 0.5/10 | 0.5/10 |
| Ex. 32 | 1/10 | 8/10 | 0.5/10 | 0.5/10 |
| Ex. 33 | 1/10 | 8/10 | 0.5/10 | 0.5/10 |
| Ex. 34 | 1/10 | 8/10 | 0.5/10 | 0.5/10 |
| Ex. 35 | 1/10 | 8/10 | 0.5/10 | 0.5/10 |
| Ex. 36 | 1/10 | 8/10 | 0.5/10 | 0.5/10 |
| Ex. 37 | 1/10 | 8/10 | 0.5/10 | 0.5/10 |
| Ex. 38 | 1/10 | 10/10 | 0.5/10 | 0.5/10 |
| Ex. 39 | 1/10 | 7/10 | 0.5/10 | 0.5/10 |
| Comp. Ex. 1 | 1/10 | 8/10 | 1/10 | 0/10 |
| Comp. Ex. 2 | 1/10 | 8/10 | 0/10 | 1/10 |
| Comp. Ex. 3 | 1/10 | 8/10 | 0/10 | 0/10 |
| Comp. Ex. 4 | 1/10 | 8/10 | (***) | (***) |
| Comp. Ex. 5 | 1/10 | 10/10 | 0/10 | 0/10 |
| Comp. Ex. 6 | 1/10 | 7/10 | 0/10 | 0/10 |

TABLE 3

| | Evaluation Test 1 Initial electrostatic characteristics | | | Evaluation Test 2 After fatigue | | | Evaluation Test 3 After exposure to nitrogen oxide gases | | |
|---|---|---|---|---|---|---|---|---|---|
| | Vm (V) | $E_{1/2}$ (1x · s) | $V_{30}$ (V) | Vm' (V) | $E_{1/2}$' (1x · s) | $V_{30}$' (V) | Vm" (V) | $E_{1/2}$" (1x · s) | $V_{30}$" (V) |
| Ex. 1 | 1615 | 1.00 | 18 | 1484 | 1.20 | 48 | 1591 | 1.03 | 21 |
| Ex. 2 | 1555 | 0.85 | 18 | 1226 | 1.15 | 48 | 1190 | 1.32 | 37 |
| Ex. 3 | 1583 | 0.90 | 18 | 1326 | 1.20 | 48 | 1322 | 1.18 | 25 |
| Ex. 4 | 1648 | 1.11 | 19 | 1521 | 1.30 | 55 | 1602 | 1.13 | 23 |
| Ex. 5 | 1703 | 1.30 | 21 | 1678 | 1.58 | 65 | 1688 | 1.32 | 27 |
| Ex. 6 | 1588 | 0.94 | 17 | 1252 | 1.11 | 43 | 1251 | 0.98 | 27 |
| Ex. 7 | 1602 | 0.98 | 18 | 1402 | 1.17 | 45 | 1452 | 1.00 | 24 |
| Ex. 8 | 1610 | 0.98 | 18 | 1444 | 1.19 | 48 | 1408 | 1.01 | 21 |
| Ex. 9 | 1590 | 0.96 | 17 | 1398 | 1.16 | 50 | 1021 | 0.97 | 21 |
| Ex. 10 | 1721 | 1.85 | 42 | 1583 | 2.25 | 87 | 1702 | 1.92 | 48 |
| Ex. 11 | 1685 | 1.35 | 30 | 1517 | 1.57 | 66 | 1666 | 1.39 | 35 |
| Ex. 12 | 1485 | 0.90 | 12 | 1307 | 1.00 | 20 | 1351 | 0.87 | 11 |
| Ex. 13 | 1252 | 0.95 | 9 | 1002 | 0.98 | 17 | 1015 | 0.90 | 7 |
| Ex. 14 | 1784 | 1.65 | 35 | 1606 | 1.93 | 63 | 1774 | 1.69 | 38 |
| Ex. 15 | 1700 | 1.30 | 28 | 1513 | 1.47 | 52 | 1687 | 1.32 | 30 |
| Ex. 16 | 1548 | 0.98 | 20 | 1362 | 1.03 | 50 | 1421 | 1.00 | 23 |
| Ex. 17 | 1497 | 1.13 | 19 | 1287 | 1.25 | 53 | 1388 | 1.15 | 22 |
| Ex. 18 | 1540 | 0.92 | 15 | 1462 | 1.06 | 43 | 1318 | 0.84 | 28 |
| Ex. 19 | 1530 | 0.95 | 16 | 1444 | 1.10 | 47 | 1325 | 0.81 | 23 |
| Ex. 20 | 1547 | 1.03 | 23 | 1199 | 1.76 | 105 | 1441 | 0.88 | 30 |
| Ex. 21 | 1526 | 0.73 | 16 | 1341 | 0.84 | 36 | 1313 | 0.81 | 22 |
| Ex. 22 | 1502 | 1.12 | 20 | 1296 | 1.36 | 45 | 1356 | 1.08 | 25 |
| Ex. 23 | 1578 | 1.26 | 25 | 1455 | 1.38 | 54 | 1421 | 1.32 | 26 |
| Ex. 24 | 1562 | 1.30 | 28 | 1422 | 1.45 | 66 | 1355 | 1.35 | 30 |
| Ex. 25 | 1628 | 1.23 | 24 | 1476 | 1.29 | 45 | 1543 | 1.25 | 25 |
| Ex. 26 | 1454 | 0.70 | 17 | 1292 | 0.77 | 35 | 1301 | 0.77 | 21 |
| Ex. 27 | 1401 | 0.73 | 14 | 1292 | 0.92 | 35 | 1294 | 0.77 | 19 |
| Ex. 28 | 1545 | 0.95 | 17 | 1343 | 1.17 | 43 | 1470 | 0.88 | 21 |
| Ex. 29 | 1550 | 0.77 | 17 | 1365 | 0.88 | 40 | 1376 | 0.81 | 23 |
| Ex. 30 | 1712 | 1.08 | 20 | 1477 | 1.22 | 54 | 1621 | 1.06 | 19 |
| Ex. 31 | 1378 | 1.12 | 28 | 1155 | 1.35 | 48 | 768 | 1.32 | 22 |
| Ex. 32 | 1688 | 1.35 | 32 | 1378 | 1.50 | 60 | 1588 | 1.38 | 30 |
| Ex. 33 | 1256 | 1.47 | 28 | 985 | 1.81 | 46 | 302 | 2.02 | 23 |
| Ex. 34 | 1311 | 1.42 | 25 | 1011 | 1.76 | 38 | 485 | 1.98 | 20 |
| Ex. 35 | 1586 | 1.38 | 30 | 1376 | 1.66 | 60 | 1498 | 1.42 | 28 |
| Ex. 36 | 1666 | 1.30 | 25 | 1585 | 1.42 | 52 | 1601 | 1.28 | 26 |
| Ex. 37 | 1485 | 1.35 | 27 | 1286 | 1.50 | 54 | 1348 | 1.30 | 30 |
| Ex. 38 | 1543 | 1.06 | 35 | 1378 | 1.15 | 58 | 1501 | 1.00 | 33 |
| Ex. 39 | 1442 | 0.77 | 15 | 1292 | 0.82 | 30 | 1001 | 0.87 | 12 |
| Comp. Ex. 1 | 1542 | 0.88 | 16 | 1337 | 1.14 | 57 | 791 | 0.81 | 21 |
| Comp. Ex. 2 | 1538 | 0.90 | 17 | 1114 | 1.06 | 41 | 1083 | 0.92 | 29 |
| Comp. Ex. 3 | 1510 | 0.82 | 18 | 1016 | 1.12 | 46 | 304 | 1.42 | 40 |
| Comp. Ex. 4 | 1546 | 0.88 | 18 | 1255 | 1.03 | 62 | 230 | 3.12 | 37 |
| Comp. Ex. 5 | 1452 | 0.80 | 34 | 1378 | 1.15 | 47 | 583 | 1.40 | 33 |
| Comp. Ex. 6 | 1328 | 0.66 | 12 | 1292 | 0.82 | 25 | 110 | 3.52 | 12 |

As can be seen from the results shown in Tables 2 and 3, since the single-layered photoconductive layer of the photoconductor according to the present invention comprises a mixture of the phenol compound and the organic sulfur-containing compound, the charging performance, in particular, the charging stability of the photoconductor is remarkably improved even after exposure to the oxidizing gases.

Further, as is apparent from the graph shown in FIG. 5, when the oxidation potential of the charge transport material employed in the single-layered photoconductive layer is +0.5 V or more (vs SCE), the charging performance is excellent. In addition, as can be seen from the data of Examples 1 to 9 shown in Tables 2 and 3, when the ratio by weight of the phenol compound to the organic sulfur-containing compound and the ratio by weight of the mixture of the phenol compound and the organic sulfur-containing compound to the binder resin are controlled within the previously mentioned preferable range, the photosensitivity is increased and the increase of the residual potential can be effectively prevented.

Comparative Example 7

[Formation of Charge Generation Layer]

10 parts by weight of the same disazo pigment of formula (20) serving as the charge generation material as employed in Example 1, and 70 parts by weight of cyclohexanone were dispersed in a ball mill for 5 days. The thus obtained dispersion of the disazo pigment was diluted with 420 parts by weight of cyclohexanone, so that a coating liquid for a charge generation layer was prepared.

The coating liquid thus prepared was coated on an aluminum plate with a thickness of 0.2 mm (Trademark "A1080", made by Sumitomo Light Metal Industries, Ltd.) by blade coating method, and dried at 100° C. for 10 minutes, so that a charge generation layer with a thickness of 0.5 μm was provided on the aluminum plate.

[Formation of Charge Transport Layer]

The following components were dissolved in 300 parts by weight of tetrahydrofuran, so that a coating liquid for a charge transport layer was prepared:

| | Parts by Weight |
|---|---|
| Z type polycarbonate resin with a molecular weight of 40,000 | 100 |
| Stilbene derivative of formula (21) serving the charge transport material | 80 |
| 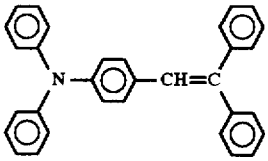 | (21) |
| Silicone oil (Trademark "KF-50", made by Shin-Etsu Chemical Co., Ltd.) | 0.1 |

The coating liquid for the charge transport layer thus prepared was coated on the charge generation layer by blade coating method, and dried at 130° C. for 20 minutes, so that a charge transport layer with a thickness of 20 μm was provided on the charge generation layer.

Thus, a comparative layered electrophotographic photoconductor No. 7 was obtained.

Comparative Example 8

The procedure for preparation of the comparative electrophotographic photoconductor No. 7 in Comparative Example 7 was repeated except that 5 parts by weight of 2,5-di-tert-butylhydroquinone (phenol compound) and 5 parts by weight of dilauryl-3,3'-thiodipropionate (organic sulfur-containing compound) were added to the composition of the coating liquid for the charge transport layer in Comparative Example 7.

Thus, a comparative layered electrophotographic photoconductor No. 8 was obtained.

[Evaluation Test 4]

After each of the electrophotographic photoconductors No. 1 according to the present invention and the comparative electrophotographic photoconductors Nos. 3, 7 and 8 was subjected to the previously mentioned Evaluation Test 1, each photoconductor was placed into a desiccator which was controlled so that the concentration of nitrogen monoxide (NO) was 40 ppm and that of nitrogen dioxide ($NO_2$) was 10 ppm, and allowed to stand in the dark for 4 days under the circumstances of 25° C. and 50% RH.

Thereafter, the photoconductor was taken out of the desiccator, and allowed to stand under the atmosphere for one day for dark adaptation. Then, the same process of charging and exposure to white light as employed in the Evaluation Test 1 was carried out. Then, the charging potential Vm'" was measured in the same manner as described in the Evaluation Test 1.

To evaluate the effects obtained by the addition of a mixture of the phenol compound and the organic sulfur-containing compound to the photoconductive layer, the charging retention ratio (Vm'"/Vm) of the photoconductor No. 1 according to the present invention was compared with that of the comparative photoconductor No. 3. In the case of the single-layered photoconductor, the charging retention ratio was improved by 88% by the addition of the aforementioned mixture to the single-layered photoconductive layer.

On the other hand, in the case of the laminated photoconductor, the charging retention ratio was increased by 27% by the addition of the mixture of the phenol compound and the organic sulfur-containing compound to the photoconductive layer when the charging retention ratio (Vm'"/Vm) of the comparative photoconductor No. 8 was compared with that of the comparative photoconductor No. 7.

As can be seen from the above-mentioned data, by use of the phenol compound and the organic sulfur-containing compound in combination in the photoconductive layer, the durability of the single-layered photoconductor with respect to the oxidizing gases is remarkably improved as compared with the case of the laminated photoconductor.

[Evaluation Test 5]

Using each of the electrophotographic photoconductor No. 1 according to the present invention and the comparative laminated electrophotographic photoconductor No. 8, the spectral sensitivity was measured in the static mode.

To be more specific, the comparative laminated photoconductor No. 8 was charged negatively under the application of −600 V, while the single-layered photoconductor No. 1 according to the present invention was charged positively under the application of +600 V.

Thereafter, the monochromatic light was applied to each photoconductor using a commercially available monochromator (available from Nikon Corporation) in such a manner that the wavelength of the applied monochromatic light was increased by 20 nm within the wavelength range of 700 to 400 nm. For evaluating the sensitivity of each photoconductor, the exposure $Em_{1/2}$ ($V \cdot cm^2/\mu J$) required to reduce the surface potential obtained just before the exposure to each monochromatic light to 2/1 the surface potential was measured.

Figure 6:
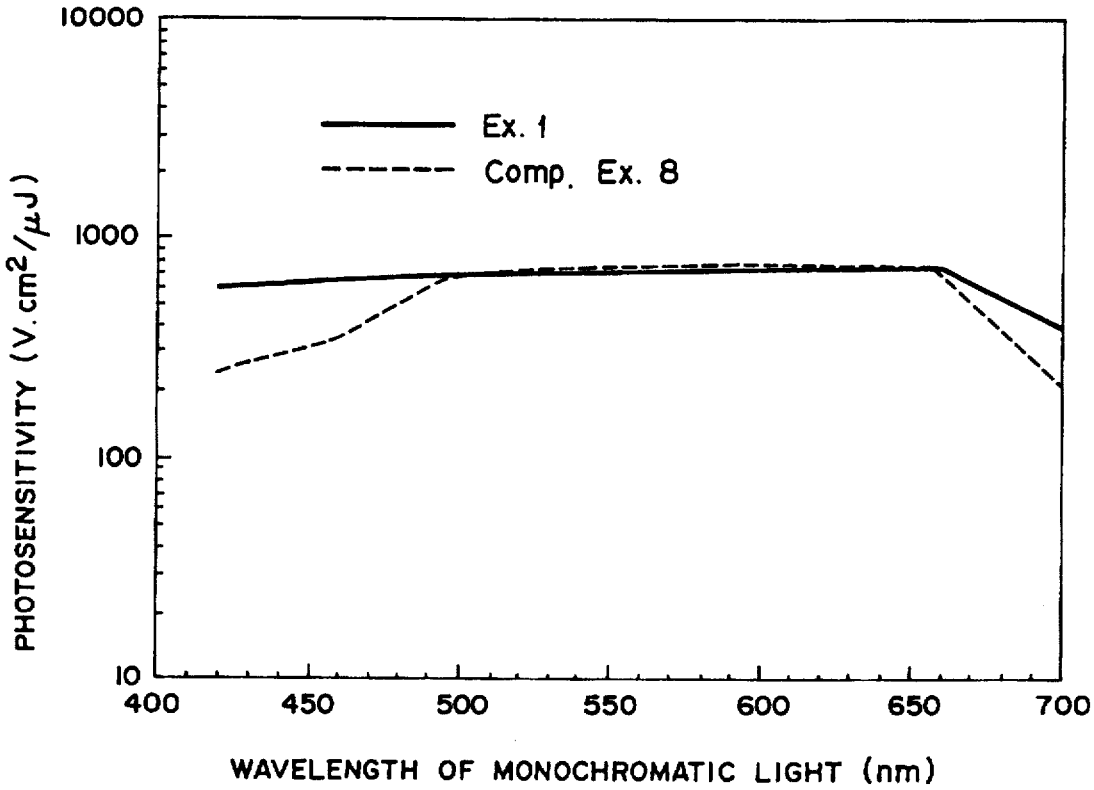
FIG. 6 is a graph which shows the spectral sensitivities of the electrophotographic photoconductor according to the present invention and the comparative electrophotographic photoconductor.

The results are shown in FIG. 6.

In the case of the laminated electrophotographic photoconductor, as can be seen from the graph shown in FIG. 6, the photosensitivity of the photoconductor is insufficient within the short wavelength range. This is because the charge transport material contained in the charge transport layer absorbs the light. In contrast to this, the photosensitivity of the single-layered electrophotographic photoconductor according to the present invention is remarkably improved in the short wavelength range.

As previously explained, the single-layered photoconductive layer of the electrophotographic photoconductor according to the present invention comprises a mixture of a phenol compound and an organic sulfur-containing compound. As a result, the photoconductor of the present invention is capable of exhibiting remarkably improved photosensitivity from the long wavelength range to the short wavelength range, and in addition, the charging performance is stabilized, especially after exposed to the oxidizing gases.

In particular, when the previously mentioned mixture comprises a hindered phenol compound or a hydroquinone compound, and a dialkyl thioalkylated compound, the charging stability is effectively improved without the decrease of photosensitivity and the increase of residual potential.

Furthermore, it is preferable that the mixing ratio by weight of the phenol compound to the organic sulfur-containing compound is within the range of 1:10 to 10:1, and that the ratio by weight of the above-mentioned mixture to the binder resin be in the range of 0.1:10 to 2:10. Further, it is preferable that the ratio by weight of the charge generation material to the binder resin be in the range of 0.1:10 to 10:10, and that the ratio by weight of the charge transport material to the binder resin be in the range of 1:10 to 15:10. When the amount ratios of the above-mentioned constituting components are controlled within the above-mentioned range, excellent charging stability can be ensured without the decrease of the photosensitivity, the increase of the residual potential, and the deterioration of the mechanical strength.

In addition, when the oxidation potential of the employed charge transport material is +0.5 V or more (vs SCE), the electrostatic characteristics are further improved.

Japanese Patent Application No. 7-224780 filed Aug. 9, 1995, and Japanese Patent Application filed Jul. 5, 1996 are hereby incorporated by reference.

What is claimed is:

1. An electrophotographic photoconductor comprising an electroconductive support, and a single-layered photoconductive layer formed thereon comprising a charge generation material, a charge transport material, a binder resin and a mixture of a phenol compound and an organic sulfur-containing compound.

2. The electrophotographic photoconductor as claimed in claim 1, wherein said mixture comprises said phenol compound and said organic sulfur-containing compound at a ratio by weight of 1:10 to 10:1.

3. The electrophotographic photoconductor as claimed in claim 1, wherein the amount of said mixture comprising said phenol compound and said organic sulfur-containing compound is in the range of 0.1 to 2 parts by weight to 10 parts by weight of said binder resin.

4. The electrophotographic photoconductor as claimed in claim 1, wherein said phenol compound comprises a hindered phenol compound.

5. The electrophotographic photoconductor as claimed in claim 1, wherein said phenol compound comprises a hydroquinone compound.

6. The electrophotographic photoconductor as claimed in claim 1, wherein said organic sulfur-containing compound comprises a dialkyl thioalkylated compound.

7. The electrophotographic photoconductor as claimed in claim 5, wherein said organic sulfur-containing compound for use in said mixture comprises a dialkyl thioalkylated compound.

8. The electrophotographic photoconductor as claimed in claim 1, wherein the amount of said charge generation material is in the range of 0.1 to 10 parts by weight to 10 parts by weight of said binder resin.

9. The electrophotographic photoconductor as claimed in claim 1, wherein said charge transport material comprises a compound having an oxidation potential of +0.5 V or more (vs SCE).

10. The electrophotographic photoconductor as claimed in claim 1, wherein the amount of said charge transport material is in the range of 1 to 15 parts by weight to 10 parts by weight of said binder resin.

* * * * *

UNITED STATES PATENT AND TRADEMARK OFFICE

CERTIFICATE OF CORRECTION

PATENT NO. : 5,702,855
DATED : DECEMBER 30, 1997
INVENTOR(S) : TAKAAKI IKEGAMI ET AL.

It is certified that error appears in the above-identified patent and that said Letters Patent is hereby corrected as shown below:

Column 5, line 39, "quitone" should read --quinone--.

Column 10, line 8, "$R^x$ and $R^{2}$" should read --$R^1$ and $R^2$--.
line 9, "or s substituted" should read --or a substituted--.
line 66, "wherein $R^1$ $R^3$ and $R^{4}$" should read --wherein $R^1$, $R^3$ and $R^4$--.

Column 17, line 35, "than the amount" should read --that the amount--.

Column 28, line 26, "exposure $Em_{1/2}$" should read --exposure $E_{1/2}$--.

Signed and Sealed this
Thirtieth Day of June, 1998

*Attest:*

*Attesting Officer*

BRUCE LEHMAN

*Commissioner of Patents and Trademarks*